US009884499B2

(12) United States Patent
Sakano

(10) Patent No.: US 9,884,499 B2
(45) **Date of Patent: *Feb. 6, 2018**

(54) TAPE CARTRIDGE

(71) Applicant: Seiko Epson Corporation, Tokyo (JP)

(72) Inventor: Hideki Sakano, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/296,403

(22) Filed: Oct. 18, 2016

(65) Prior Publication Data

US 2017/0036464 A1 Feb. 9, 2017

Related U.S. Application Data

(63) Continuation of application No. 14/741,301, filed on Jun. 16, 2015, now Pat. No. 9,498,994, which is a (Continued)

(30) Foreign Application Priority Data

Mar. 24, 2014 (JP) ..... 2014-060916

(51) Int. Cl.
*B41J 15/04* (2006.01)
*B41J 2/325* (2006.01)
(Continued)

(52) U.S. Cl.
CPC ..... *B41J 15/044* (2013.01); *B41J 2/325* (2013.01); *B41J 3/4075* (2013.01); *B41J 32/00* (2013.01);
(Continued)

(58) Field of Classification Search
None
See application file for complete search history.

(56) References Cited

U.S. PATENT DOCUMENTS 5,853,254 A 12/1998 Inakoshi et al.
6,007,263 A 12/1999 Imai et al.
(Continued)

FOREIGN PATENT DOCUMENTS

JP 2002-178572 A 6/2002
JP 3606042 B 10/2004
(Continued)

OTHER PUBLICATIONS

Non-Final Office Action received in U.S. Appl. No. 14/741,301, dated Aug. 17, 2015.
(Continued)

*Primary Examiner* — An Do
*Assistant Examiner* — Renee I Wilson
(74) *Attorney, Agent, or Firm* — ALG Intellectual Property, LLC

(57) ABSTRACT

A tape cartridge is detachably installed on a cartridge installation portion of a tape printing apparatus having a platen supporting shaft and a printing head. A base end of the platen supporting shaft is fixed to the cartridge installation portion at one end of the platen supporting shaft. The tape cartridge includes the platen roller, the upper bearing portion, the lower bearing portion, and the fitting portion. The platen roller includes an upper and lower engagement portion. The upper bearing portion rotatable supports the upper engagement portion and restricts movement of the upper engagement portion. The lower bearing portion rotatable supports the lower engagement portion and restricts movement of the lower engagement portion. The fitting portion in which a tip end of the platen supporting shaft passing through the platen roller fits when the tape cartridge is installed on the cartridge installation portion.

4 Claims, 9 Drawing Sheets

Related U.S. Application Data continuation of application No. PCT/JP2015/058317, filed on Mar. 19, 2015.

(51) Int. Cl.

| | |
|---|---|
| ***B41J 32/02*** | (2006.01) |
| ***B41J 35/28*** | (2006.01) |
| ***B41J 3/407*** | (2006.01) |
| ***B41J 32/00*** | (2006.01) |

(52) U.S. Cl.

CPC ..... *B41J 32/02* (2013.01); *B41J 35/28* (2013.01); *B41J 2202/31* (2013.01)

(56) References Cited

U.S. PATENT DOCUMENTS

| | | | |
|---|---|---|---|
| 2007/0264070 | A1 | 11/2007 | Loo et al. |
| 2010/0272492 | A1 | 10/2010 | Van Britsom et al. |

FOREIGN PATENT DOCUMENTS

| | | | |
|---|---|---|---|
| JP | 3629823 | B | 12/2004 |
| JP | A-2011-046142 | | 3/2011 |
| WO | WO-9749560 | A | 12/1997 |

OTHER PUBLICATIONS

International Search Report, dated Jun. 9, 2015, issued in related Patent Application No. PCT/JP2015/058317.

Final Office Action received in U.S. Appl. No. 14/741,301, dated Feb. 16, 2016.

Notice of Allowance and Notice of Allowability received in U.S. Appl. No. 14/741,301, dated Jul. 21, 2016.

TAPE CARTRIDGE

CROSS REFERENCE TO RELATED APPLICATION

The present application is a continuation application of U.S. patent application Ser. No. 14/741,301 filed on Jun. 16, 2015, which is a continuation of PCT application No. PCT/JP2015/058317 which was filed on Mar. 19, 2015, which claims priority to Japanese Patent Application No. 2014-060916 filed on Mar. 24, 2014, the contents of which are incorporated herein by reference.

BACKGROUND

1. Technical Field

The present invention relates to a tape cartridge installed on the cartridge installation portion of a tape printing apparatus to be used and subjected to printing by the tape printing apparatus.

2. Background Art

Up until now, a tape cassette installed in a printing apparatus to be used has been known as such a tape cartridge. See Japanese Patent No. 3629823.

The tape cassette includes a tape supplying reel on which a printing tape is wound, a ribbon supplying reel on which an ink ribbon is wound, a ribbon winding-up reel that winds up the ink ribbon, and a cassette casing that accommodates these constituents.

On the other hand, the printing apparatus includes a cassette cover at the upper surface of an apparatus main body and a cassette accommodation portion, on which the tape cassette is detachably installed, inside the cassette cover. In the cassette accommodation portion, a printing head, a platen roller, a tape supplying shaft, and a ribbon winding-up shaft are disposed in their standing state. When the tape cassette is installed on the cassette accommodation portion, the tape supplying shaft and the ribbon winding-up shaft are inserted in the tape supplying reel and the ribbon winding-up reel, respectively.

The platen roller is rotatably attached to a U-shaped supporting member via a shaft. In addition, the supporting member is rotatably attached to a chassis via a supporting shaft. The supporting member rotates with the closing of the cassette cover and comes in contact with the printing head. On the other hand, the printing head is fixed to the chassis via a protection member. An engagement projection is provided to stand on the upper surface of the protection member and engages with an interval restriction member provided to freely rise and fall on the upper end surface of the chassis. That is, with the interval restriction member, the tape cassette is structured to restrict the interval between the upper end of the printing head and that of the platen roller at a constant interval. Thus, the printing head and the upper end of the platen roller are prevented from relatively separating from each other at printing and brought into uniformly press-contact with each other to attain an improvement in printing quality.

In such a known printing apparatus, the interval restriction member is provided to maintain the uniform press-contact between the printing head and the platen roller. This results in the problem that the structure of this portion becomes complicated. In addition, it is required to insert the printing tape and the ink ribbon between the printing head and the platen roller at the installation of the tape cassette. Therefore, it is required to rise and fall the interval restriction member is required for the attachment/detachment of the tape cassette, which results in the problem that an operation becomes complicated.

The present invention has an object of providing a tape cartridge that allows the platen supporting shaft of a tape printing apparatus to be supported at both ends thereof with a simple structure and a simple operation.

SUMMARY OF THE INVENTION

According to the present invention, there is provided a tape cartridge detachably installed on a cartridge installation portion of a tape printing apparatus having a platen supporting shaft and a printing head, a base end of the platen supporting shaft being fixed to the cartridge installation portion at one end of the platen supporting shaft and extending in an attaching/detaching direction of the tape cartridge. The tape cartridge includes a platen roller through which the platen supporting shaft passes when the tape cartridge is installed on the cartridge installation portion and which receives a pressing force from the printing head when a printing operation is performed in a state in which the tape cartridge is installed on the cartridge installation portion, and a fitting portion in which a tip end of the platen supporting shaft passing through the platen roller fits when the tape cartridge is installed on the cartridge installation portion.

In this case, the tape cartridge preferably further includes a cartridge casing that supports both ends of the platen roller in an axial direction of the platen roller, and the fitting portion is preferably provided on a casing wall on a near side of the cartridge casing in the attaching direction of the attaching/detaching direction.

According to these configurations, when the tape cartridge is installed on the cartridge installation portion, the cartridge casing is positioned at the cartridge installation portion and the platen supporting shaft of the tape printing apparatus is inserted in the platen roller. At the same time, the tip end side of the platen supporting shaft fits in the fitting portion of the casing wall. Thus, the tip end side of the platen supporting shaft with one end thereof supported is held by the cartridge casing via the fitting portion. That is, only by the installation of the tape cartridge on the cartridge installation portion, the platen supporting shaft can be supported at both ends thereof. Accordingly, with the simple structure and the simple operation, it becomes possible to suppress the inclination of the platen supporting shaft due to the pressing force of the printing head while effectively reducing vibrations likely to occur in the cantilevered platen supporting shaft in a printing operation and make the platen supporting shaft supported at both ends thereof.

In addition, the fitting portion preferably has a fitting hole to support the tip end of the platen supporting shaft.

According to this configuration, the platen supporting shaft can fit in the fitting portion irrespective of the type of the tape cartridge provided that the platen supporting shaft is formed to have a length corresponding to the tape cartridge having a maximum width with respect a plurality of types of tape cartridges having a different thickness. That is, it becomes possible to make the platen supporting shaft supported at both ends thereof with respect to the plurality of types of tape cartridges.

In addition, the tape cartridge preferably further includes a bearing hole portion that is provided on the cartridge casing and supports and allows the platen roller to move in a radial direction of the platen roller when the tape cartridge is not installed on the cartridge installation portion.

According to this configuration, even if a manufacturing positional deviation occurs in the platen supporting shaft, which is inserted in the platen roller and fitted in the fitting portion, between the center of the platen roller and the center of the fitting portion, the platen supporting shaft has no problem in its insertion in the platen roller and fitting in the fitting portion.

In this case, the bearing hole portion preferably has a first bearing hole provided on the casing wall on the near side of the cartridge casing in the attaching direction and a second bearing hole provided on a casing wall on a back side of the cartridge casing in the attaching direction, and the fitting hole preferably communicates with the first bearing hole.

According to this configuration, it becomes possible to allow the platen roller to move in the radial direction when the tape cartridge is not installed on the cartridge installation portion while allowing the platen supporting shaft to be appropriately supported at both ends thereof when the tape cartridge is installed.

The tape cartridge preferably further includes a printing tape mounted on the cartridge casing so as to be fed out from the tape cartridge. The bearing hole preferably allows the platen roller to move in the radial direction between a restraint position at which the feeding of the printing tape is restrained and a restraint canceling position at which the restraint is cancelled, and the platen supporting shaft is preferably inserted in the platen roller moved to the restraint canceling position when the tape cartridge is installed on the cartridge installation portion.

According to this configuration, the platen roller can reliably move to the restraint canceling position when the tape cartridge is installed on the cartridge installation portion and move to the restraint position as occasion demands when the tape cartridge is not installed.

DETAILED DESCRIPTION OF THE EMBODIMENTS

Hereinafter, a description will be given, with reference to the accompanying drawings, of a tape cartridge according to an embodiment of the present invention in conjunction with a tape printing apparatus in which the tape cartridge is installed. The tape printing apparatus is used to perform printing while feeding out a printing tape and an ink ribbon from the installed tape cartridge and cut off a printed part of the printing tape to create a label (tape piece).

[Outline of Tape Printing Apparatus]

Figure 1:
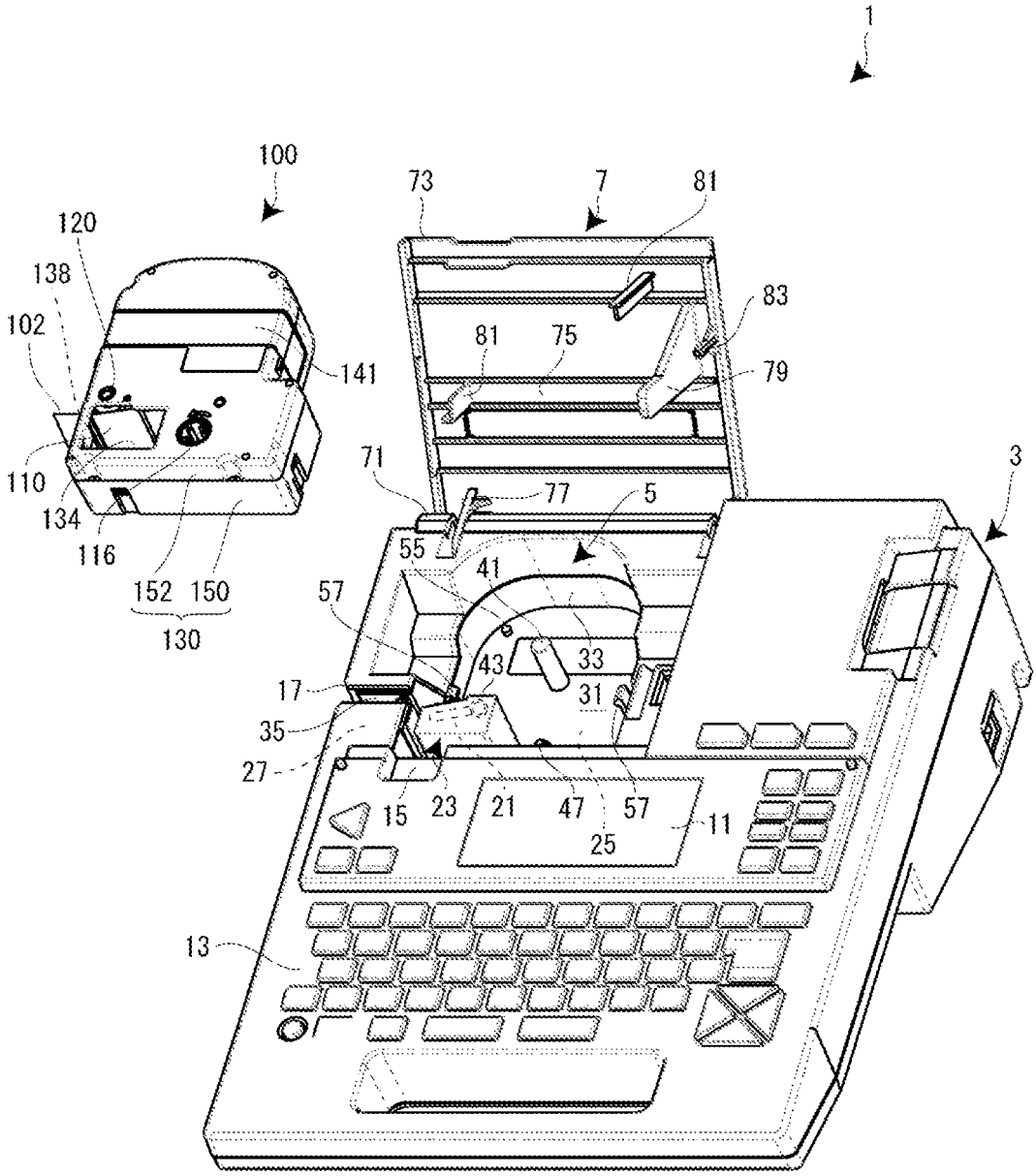
FIG. 1 is an external perspective view of a tape printing apparatus according to an embodiment with its cover opened.

FIG. 1 is an external perspective view of the tape printing apparatus and the tape cartridge installed in the tape printing apparatus. As shown in FIG. 1, a tape printing apparatus 1 includes an apparatus casing 3 constituting an outer shell, a cartridge installation portion 5 on which a tape cartridge 100 is detachably installed, and an opening/closing cover 7 used to open/close the cartridge installation portion 5. At the upper surface of the apparatus casing 3, the cartridge installation portion 5 is provided on the back side, a display 11 is provided on the central side, and a keyboard 13 is provided on the near side. In the vicinity of the opening/closing cover 7, a finger-hooking recessed portion 15 is provided. The opening/closing cover 7 is opened when the recessed portion 15 is hooked and raised by a finger. Further, on the side surface (left side surface) of the apparatus casing 3, an elongated tape ejection port 17 is provided to eject a printing tape 102.

In addition, the tape printing apparatus 1 includes a printing mechanism portion 23 having a printing head 21 provided to stand on the cartridge installation portion 5, a tape feeding mechanism portion 25 embedded in the back side space of the cartridge installation portion 5, and a tape cutting mechanism portion 27 embedded in the vicinity of the tape ejection port 17. A user enters printing information via the keyboard 13 and performs printing with a key operation after confirming the printing information on the display 11. Upon the printing instruction, the tape feeding mechanism portion 25 is driven to make the printing tape 102 and the ink ribbon 110 run parallel to each other. Moreover, by heat applied from the printing mechanism portion 23 to the ink ribbon 110, the ink of the ink ribbon 110 is transferred to the printing tape 102 to perform the printing. By the print feeding, the printing tape 102 is ejected from the tape ejection port 17. When the printing is completed, the tape cutting mechanism portion 27 is driven to cut off a printed part of the printing tape 102.

[Outline of Tape Cartridge]

As shown in FIGS. 2A and 2B and FIGS. 5A and 5B, the tape cartridge 100 includes a tape roll 106 in which the printing tape 102 is wound on a tape core 104 and a ribbon roll 114 in which the ink ribbon 110 is wound on a feeding-out core 112. In addition, the tape cartridge 100 includes a winding-up core 116 that winds up the ink ribbon 110 that has been consumed and a platen roller 120 (platen) that comes in contact with the printing head 21 and feeds the printing tape 102 and the ink ribbon 110. Moreover, the tape cartridge 100 includes a cartridge casing 130 that accommodates the tape roll 106, the ribbon roll 114, the winding-up core 116, and the platen roller 120. As described above, the tape cartridge 100 of this embodiment has so-called a shell structure in which the outer shell is covered with the cartridge casing 130.

Further, the tape cartridge 100 includes an insertion opening 134, in which the printing head 21 is inserted when the tape cartridge 100 is installed in the tape printing apparatus 1, on the cartridge casing 130. Furthermore, the tape cartridge 100 includes a tape delivering port 138 that is formed on the cartridge casing 130 and from which the printing tape 102 is delivered. Note that as will be described in detail later, the tape roll 106 is rotatably supported by a cylindrical core shaft 192 projecting inside the cartridge casing 130 (see FIG. 5A).

When the platen roller 120 and the winding-up core 116 are driven by the tape feeding mechanism portion 25, the printing tape 102 is fed out from the tape core 104 and the ink ribbon 110 is fed out from the feeding-out core 112. The fed-out printing tape 102 and the ink ribbon 110 run parallel to each other at the platen roller 120 and are subjected to printing by the printing head 21. A fed-out end (printed part) of the printing tape 102, on which the printing has been performed, is delivered from the tape delivering port 138 to the tape ejection port 17. On the other hand, the ink ribbon 110 goes around the peripheral wall part of the insertion opening 134 and is wound up by the winding-up core 116. Note that a plurality of types of tape cartridges having a different thickness is available as the tape cartridge 100 according to a tape width of the printing tape 102.

[Details of Tape Printing Apparatus]

Figure 3:
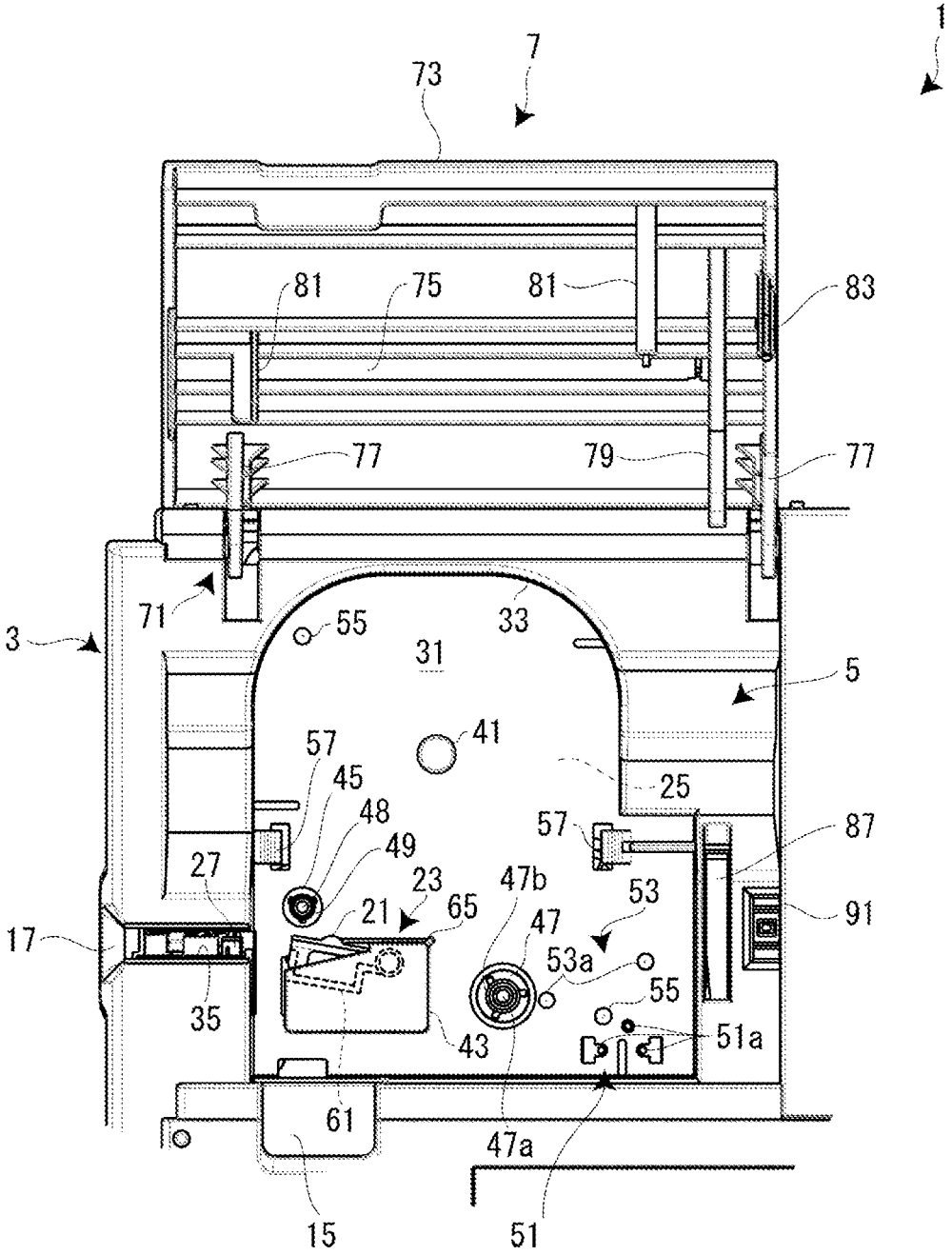
FIG. 3 is a plan view of a cartridge installation portion.

As shown in FIG. 1 and FIG. 3, the cartridge installation portion 5 is formed in a flat shape complementary to the flat shape of the tape cartridge 100 and formed to be recessed with a depth corresponding to the tape cartridge 100 having a maximum thickness among the plurality of types of installable tape cartridges 100. In this case, an installation base 31 constituting the bottom plate portion of the cartridge installation portion 5 and a side plate portion 33 are integrally formed (molded) by a resin or the like. A slit-shaped tape ejection path 35 is formed between the cartridge installation portion 5 and the tape ejection port 17, and the tape cutting mechanism portion 27 is embedded at this part.

On the installation base 31 of the cartridge installation portion 5, a positioning projection 41 in which the core shaft 192 fits to be positioned, the printing head 21 covered with a head cover 43, a platen driving shaft 45 that rotates and drives the platen roller 120, and a winding-up driving shaft 47 that rotates and drives the winding-up core 116 are provided to stand. In addition, on the installation base 31, a tape detection portion 51 that detects a type (attribute information) of the printing tape 102 is provided in the vicinity of the winding-up driving shaft 47.

Similarly, on the installation base 31, a core releasing portion 53 that releases the rotation-stop of the feeding-out core 112 and the winding-up core 116 is provided in the vicinity of the winding-up driving shaft 47. Moreover, on the installation base 31, a pair of small projections 55 is provided at the diagonal positions, and a pair of retaining pieces 57 that retain the intermediate part of the installed tape cartridge 100 is provided.

Further, in the back side space of the installation base 31, the tape feeding mechanism portion 25 constituted of a motor, a gear train (each not shown), or the like that rotates the platen driving shaft 45 and the winding-up driving shaft 47 is embedded. The tape feeding mechanism portion 25 branches power with the gear train and causes the platen driving shaft 45 and the winding-up driving shaft 47 to rotate in synchronization with each other.

The printing mechanism portion 23 includes the printing head 21 constituted of a thermal head and a head supporting frame 61 that supports and rotates the printing head 21. In addition, the printing mechanism portion 23 includes a head releasing mechanism (not shown) that rotates the printing head 21 between a printing position and a retracting position via the head supporting frame 61 and the head cover 43 that covers the printing head 21 (and the head supporting frame 61).

The head releasing mechanism operates as the opening/closing cover 7 is opened/closed. The head releasing mechanism moves (rotates) the printing head 21 to the printing position according to the closing operation of the opening/closing cover 7 and moves (rotates) the printing head 21 to the retracting position according to the opening operation thereof. The printing head 21 comes in contact with the platen roller 120 via the ink ribbon 110 and the printing tape 102 when moving to the printing position and separates from the platen roller 120 when moving to the retracting position. Thus, the printing tape 102 and the ink ribbon 110 are prevented from interfering with the printing head 21 when the tape cartridge 100 is attached/detached.

The printing head 21 is provided with a plurality of heat generation elements, and the plurality of heat generation elements lines up in the same direction as the shaft direction of the platen roller 120. Further, printing is performed when the printing tape 102 and the ink ribbon 110 are fed and the plurality of heat generation elements is selectively driven. The head cover 43 is formed in a substantially rectangle shape in plan view and integrally formed (molded) with the installation base 31 (the cartridge installation portion 5). In addition, the head cover 43 vertically largely projects from the installation base 31. The head cover 43 internally allows the rotation of the printing head 21 and externally functions as an installation guide for the tape cartridge 100.

The tape detection portion 51 is constituted of a plurality of micro switches 51*a*, selectively engages with a detected portion 180 of the tape cartridge 100 that will be described later, and detects a type (attribute information) of the tape cartridge 100 such as a tape width, a tape color, and a material of the printing tape 102. Further, based on the detection result, the driving of the printing head 21 and the tape feeding mechanism portion 25 is controlled.

The core releasing portion 53 is constituted of two releasing pins 53*a* for the feeding-out core 112 and the winding-up core 116. As will be described in detail later, the cartridge casing 130 is provided with rotation-stop hooks 206 retained by the feeding-out core 112 and the winding-up core 116, respectively (see FIG. 6). When the tape cartridge 100 is installed, the releasing pins 53*a* engage with the rotation-stop hooks 206 to release the rotation-stop of the feeding-out core 112 and the winding-up core 116.

The platen driving shaft 45 includes a platen supporting shaft 48 elongated so to be inserted in the platen roller 120 and a spline-shaped rotation driving shaft 49 rotatably supported (journaled) in the base portion of the platen supporting shaft 48 (see FIG. 3). The rotation power of the tape feeding mechanism portion 25 is transmitted to the rotation driving shaft 49 and then transmitted from the rotation driving shaft 49 to the platen roller 120 (that will be described in detail later).

Similarly, the winding-up driving shaft 47 includes a fixation shaft 47*a* and a spline-shaped movable shaft 47*b* rotatably supported in the fixation shaft 47*a*. In this case as well, the rotation power of the tape feeding mechanism portion 25 is transmitted to the movable shaft 47*b* and then further transmitted from the movable shaft 47*b* to the winding-up core 116.

When the tape cartridge 100 is installed on the cartridge installation portion 5, the core shaft 192 (the tape core 104) engages with the positioning projection 41. In addition, the platen roller 120 engages with the platen driving shaft 45, and the winding-up core 116 engages with the winding-up driving shaft 47. Then, when the opening/closing cover 7 is closed, the printing head 21 rotates and comes in contact with the platen roller 120 with the printing tape 102 and the ink ribbon 110 held therebetween, which brings the tape printing apparatus 1 in a printing standby state.

Figure 4:
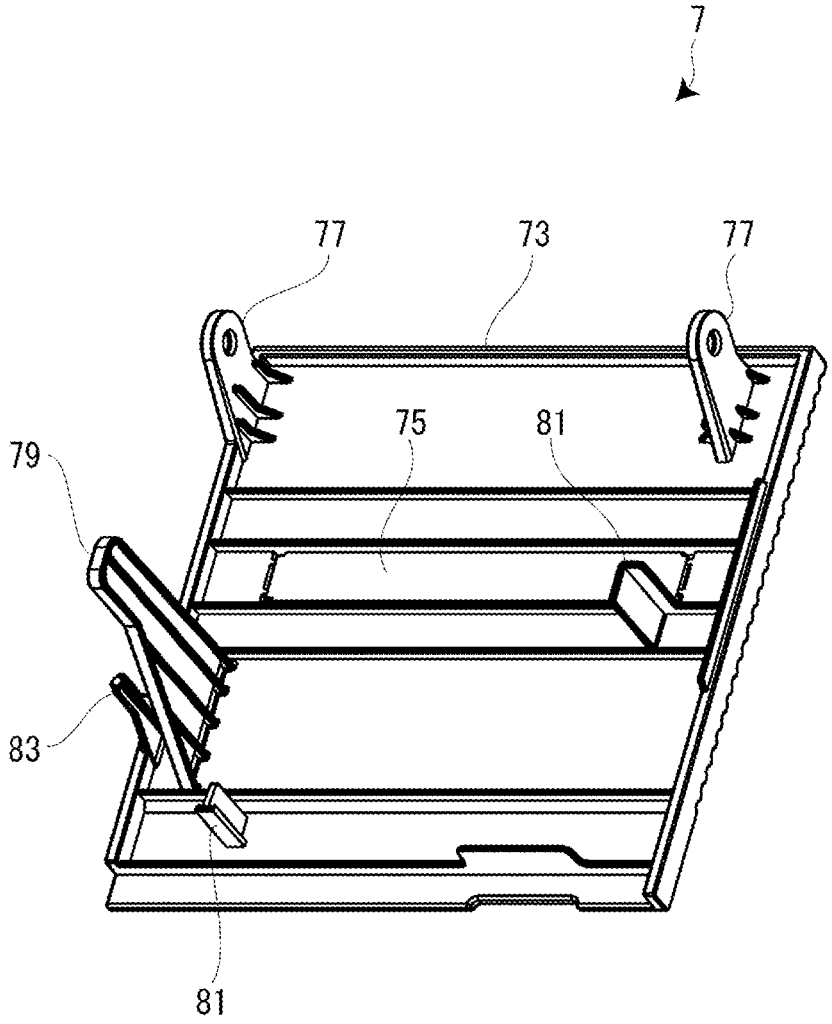
FIG. 4 is a perspective view of the opening/closing cover when seen from the side of its rear surface.

As shown in FIG. 1 and FIG. 4, the opening/closing cover 7 is rotatably, i.e., openably/closably attached to the apparatus casing 3 via a hinge portion 71 provided on the back side. The opening/closing cover 7 includes an opening/ closing cover main body 73, a check window 75 provided at the center of the opening/closing cover main body 73, and a pair of supported pieces 77 that projects from the rear surface of the opening/closing cover main body 73 and is rotatably supported in the hinge portion 71. In addition, the opening/closing cover 7 includes an operation lever 79 that projects from the rear surface of the opening/closing cover main body 73 and rotates the printing head 21 and two pressing projections 81 that project from the rear surface of the opening/closing cover main body 73 and press the tape cartridge 100. Moreover, the opening/closing cover 7 includes a pressing projection 83 that projects from the rear surface of the opening/closing cover main body 73 and operates (turns ON) an embedded cover closing detection switch (not shown).

The check window 75 is formed to be long from side to side and made of a transparent (visible-light transparent) resin formed separately from the opening/closing cover main body 73. Through the check window 75, (a type and a tape remaining amount of the printing tape 102 of) the tape cartridge 100 installed on the cartridge installation portion 5 can be visually checked. In addition, the pair of supported pieces 77, the operation lever 79, the two pressing projections 81, and the pressing projection 83 are integrally formed (molded) with the opening/closing cover main body 73 by a resin.

The operation lever 79 largely projects from the rear surface of the opening/closing cover main body 73 and is inserted in a slit opening 87 provided on the lateral side of the cartridge installation portion 5 as the opening/closing cover 7 is closed. The operation lever 79 inserted in the slit opening 87 causes the head releasing mechanism described above to operate and the printing head 21 to rotate. Similarly, as the opening/closing cover 7 is closed, the pressing projection 83 is inserted in a rectangle opening 91 adjacent to the slit opening 87 to operate (turn "ON") the cover closing detection switch.

One of the pressing projections 81 is positioned so as to be in the vicinity of the platen roller 120 of the tape cartridge 100, and the other of the processing projections 81 is positioned so as to be right above the tape detection portion 51. When the opening/closing cover 7 is closed, the two pressing projections 81 press the tape cartridge 100 so as to be set on the installation base 31 of the cartridge installation portion 5 and prevent the tape cartridge 100 from floating.

[Details of Tape Cartridge]

Next, a description will be given in detail of the tape cartridge 100 with reference to FIGS. 2A and 2B, FIGS. 5A and 5B, and FIG. 6. Note that in the description of the tape cartridge 100, taking FIGS. 2A and 2B as an example, a surface on the near side in the installation direction, i.e., on the upper front side of the tape cartridge 100 will be called a "front surface," a surface on the back side in the installation direction, i.e., on the opposite side of the tape cartridge 100 will be called a "rear surface," a side surface on the left side of the tape cartridge 100 will be called a "left side surface," a side surface on the right side thereof will be called a "right side surface," an arc-shaped side surface on the upper side thereof will be called a "tip end surface," and a side surface on the lower side thereof will be called a "base end surface."

As described above, the tape cartridge 100 includes the cartridge casing 130 and the tape roll 106, the ribbon roll 114, the winding-up core 116, and the platen roller 120 accommodated in the cartridge casing 130. In addition, the tape cartridge 100 includes the insertion opening 134 provided on the cartridge casing 130, the tape delivering port 138 formed on the left side surface in the vicinity of the platen roller 120, and an identification label 141 (see FIG. 1) affixed from the left side surface to the right side surface via the front surface at a position at which the tape roll 106 is accommodated. On the identification label 141, (some of attribute information such as) a tape width, a tape color, and a material of the printing tape 102 accommodated in the cartridge casing 130 are displayed at the two places of the front surface and the left side surface.

The cartridge casing 130 constitutes the outer shell of the tape cartridge 100 (the shell structure) and has an appearance that is formed in an "L"-shape in plan view and of which the base end at the right side surface slightly projects. In the front and rear direction, the cartridge casing 130 is constituted of a lower casing 150 and an upper casing 152, the lower casing 150 and the upper casing 152 being positioned on the back side and the near side, respectively, when the cartridge casing 130 is installed on the cartridge installation portion 5. In the cartridge casing 130 of the embodiment, the upper casing 152 is constituted of a transparent resin molded item, and the lower casing 150 is constituted of a non-transparent resin molded item.

The upper casing 152 is such that a top wall portion 156 constituting the front surface of the cartridge casing 130 and an upper peripheral wall portion 158 suspending on the periphery of the top wall portion 156 are integrally formed (molded). In addition, the lower casing 150 is such that a bottom wall portion 160 constituting the rear surface of the cartridge casing 130, a lower peripheral wall 162 provided to stand on the periphery of the bottom wall portion 160, and an opening peripheral wall portion 164 provided to stand on the bottom wall portion 160 so as to define the insertion opening 134 are integrally formed (molded).

On the lower end surface of the upper peripheral wall portion 158 of the upper casing 152, a plurality of joining pins 170 is provided at appropriate intervals. While, on the lower peripheral wall 162 of the lower casing 150, a plurality of joining holes 172 is provided corresponding to the plurality of joining pins 170 (see FIGS. 5A and 5B). After constituents such as the tape roll 106 and the ribbon roll 114 are disposed on the lower casing 150, the upper casing 152 is joined to the lower casing 150 so as to press-fit the plurality of joining pins 170 in the plurality of joining holes 172, whereby the tape cartridge 100 is assembled. Note that the respective joining holes 172 are formed as through holes from the viewpoint of molding easiness.

Figure 2A:
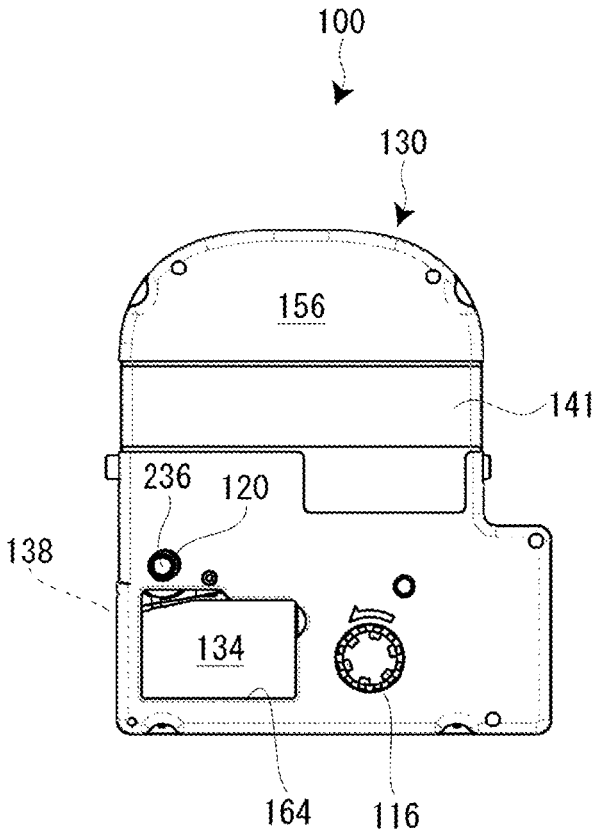
FIGS. 2A and 2B are, respectively, a plan view and a side surface view of a tape cartridge according to the embodiment.
Figure 2B:
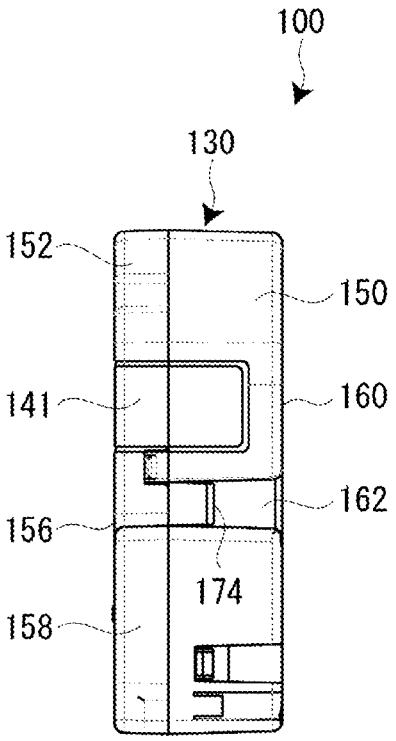
Figure 6:
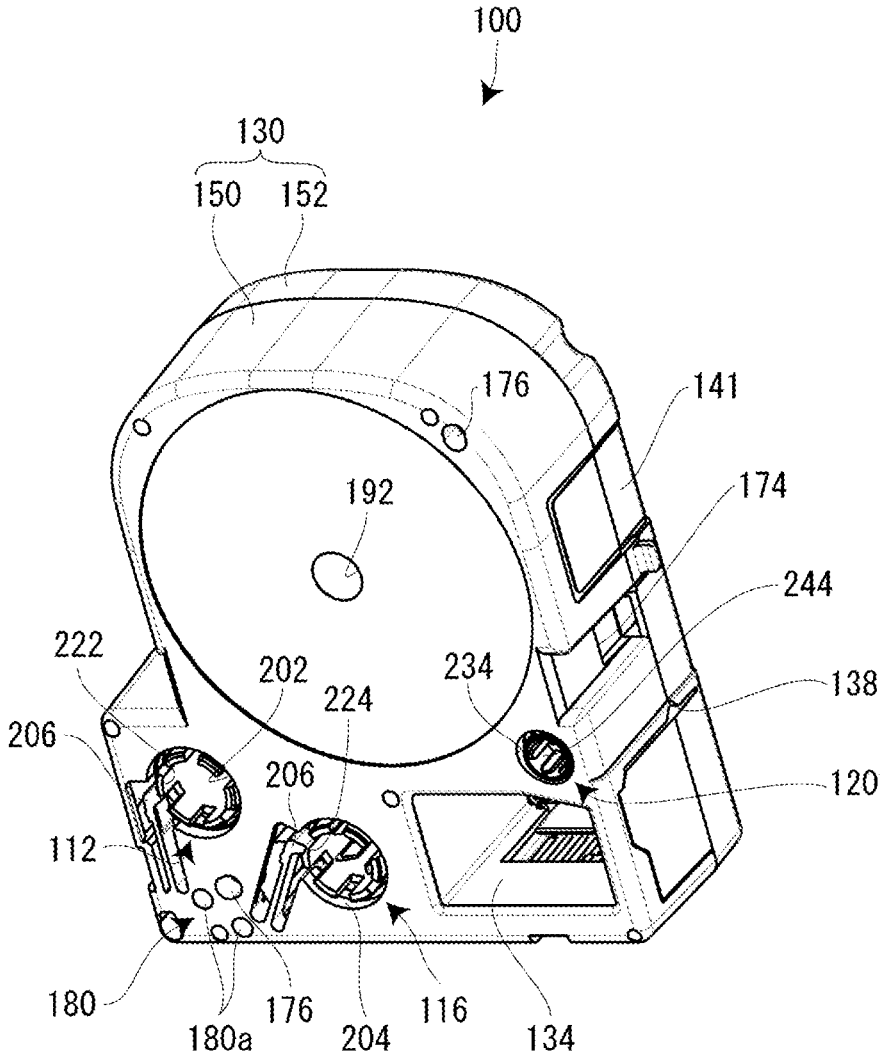
FIG. 6 is a perspective view of the tape cartridge when seen from the side of its rear surface.

On the other hand, on the left side surface and the right side surface of the lower casing 150, a pair of retaining-reception portions 174 retained by the pair of retaining pieces 57 is provided (see FIGS. 2A and 2B and FIG. 6). When the pair of retaining-reception portions 174 of the installed tape cartridge 100 is retained by the pair of retaining pieces 57 on the side of the cartridge installation portion 5, the tape cartridge 100 is prevented from floating. In addition, on the rear surface of the lower casing 150, small fitting holes 176 in which the pair of small projections 55 fits with slight room are provided (see FIG. 6). When the pair of small projections 55 on the side of the cartridge installation portion 5 fits in the pair of small fitting holes 176 of the installed tape cartridge 100, the tape cartridge 100 is easily positioned on the installation base 31.

Moreover, on the rear surface of the lower casing 150, the detected portion 180 corresponding to the tape detection portion 51 is provided at a left corner part on the side of the base end surface (i.e., at a right corner part as seen from the side of the front surface) (see FIG. 6). The detected portion 180 is constituted at a place corresponding to the plurality of micro switches 51*a* of the tape detection portion 51, and a plurality of bit patterns is obtained based on the presence or absence of reception holes 180*a* provided at the place. That is, the bit patterns correspond to a type of the printing tape 102.

As shown in FIG. 5, in upper side space (on the side of the tip end surface) inside the cartridge casing 130, a tape accommodation area 190 in which the tape roll 106 is widely accommodated is constituted. At the center of the tape accommodation area 190, the core shaft 192 integrally formed (molded) with the lower casing 150 is provided to stand. The core shaft 192 is formed in a cylindrical shape, and the tape roll 106 (the tape core 104) is rotatably supported in the outer peripheral surface of the core shaft 192.

In addition, in the tape accommodation area 190, a tape guide 194 that guides the fed-out printing tape 102 to the platen roller 120 is integrally formed with the lower casing 150 so as to stand in the vicinity of the platen roller 120. That is, inside the cartridge casing 130, a tape feeding path 196 ranging from the tape roll 106 as a starting point to the tape delivering port 138 via the tape guide 194 and the platen roller 120 is constituted. The printing tape 102 fed out from the tape roll 106 is guided to the platen roller 120 via the tape guide 194 and subjected to printing by the platen roller 120. Then, the printing tape 102 is further guided from the platen roller 120 to the tape delivering port 138.

The tape roll 106 includes two circular films 198 affixed to both end surfaces of the roll-shaped printing tape 102, besides the printing tape 102 and the tape core 104. The two circular films 198 prevent the printing tape 102 wound on the tape core 104 from spreading out. In addition, although not shown in the figures, a reverse-rotation stop mechanism is embedded in the tape core 104. When the tape cartridge 100 is carried, the reverse rotation of the printing tape 102 is prevented by the reverse-rotation stop mechanism. On the other hand, when the tape cartridge 100 is installed on the cartridge installation portion 5 of the tape printing apparatus 1, the reverse-rotation stop of the reverse-rotation stop mechanism is released by the positioning projection 41, whereby the feeding of the printing tape 102 is made possible.

On the right side of a base portion inside the cartridge casing 130, a ribbon accommodation area 200 is constituted adjacent to the insertion opening 134. In the ribbon accommodation area 200, a feeding-out-side bearing portion 202 that rotatably supports the ribbon roll 114 (the feeding-out core 112) and a winding-up-side bearing portion 204 that rotatably supports the winding-up core 116 are integrally formed with the cartridge casing 130 on the right and left parts, respectively. That is, the feeding-out-side bearing portion 202 and the winding-up-side bearing portion 204 are formed on each of the upper casing 152 and the lower casing 150.

The notched parts of the feeding-out-side bearing portion 202 and the winding-up-side bearing portion 204 formed on the lower casing 150 are each integrally formed with the rotation-stop hooks 206 having the tip end thereof facing the feeding-out-side bearing portion 202 and the winding-up-side bearing portion 204. Further, one and the other of rotation-stop hooks 206 engage with the feeding-out core 112 and the winding-up core 116, respectively, in their rotation stopping state.

In the ribbon accommodation area 200, a first ribbon guide 210 that guides the fed-out ink ribbon 110 to the platen roller 120 is integrally formed with the lower casing 150 so as to stand in the vicinity of the feeding-out-side bearing portion 202. In addition, on the outer peripheral side of the opening peripheral wall portion 164, a plurality of second ribbon guides 212 that guides the going-around of the ink ribbon 110 is integrally formed.

That is, inside the cartridge casing 130, a ribbon feeding path 214 ranging from the ribbon roll 114 as a starting point to the winding-up core 116 via the first ribbon guide 210, the platen roller 120, and the plurality of second ribbon guides 212 is constituted. The ink ribbon 110 fed out from the ribbon roll 114 is guided to the platen roller 120 via the first ribbon guide 210 and subjected to printing by the platen roller 120. Moreover, the ink ribbon 110 goes around the opening peripheral wall portion 164 (the plurality of second ribbon guides 212) via the platen roller 120 and is wound up by the winding-up core 116.

Figure 5A:
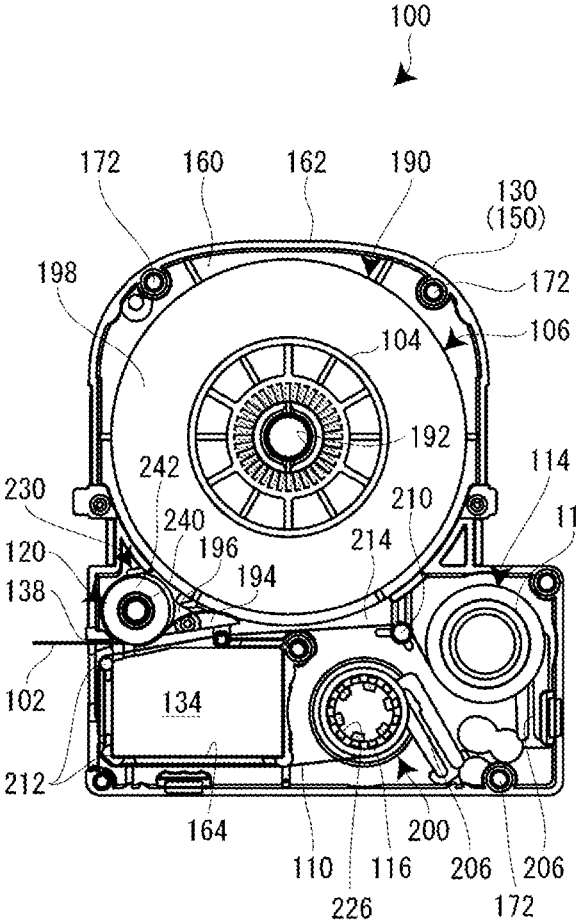
FIGS. 5A and 5B are, respectively, a plan view of the tape cartridge with its upper casing removed and a rear surface view of the upper casing.
Figure 5B:
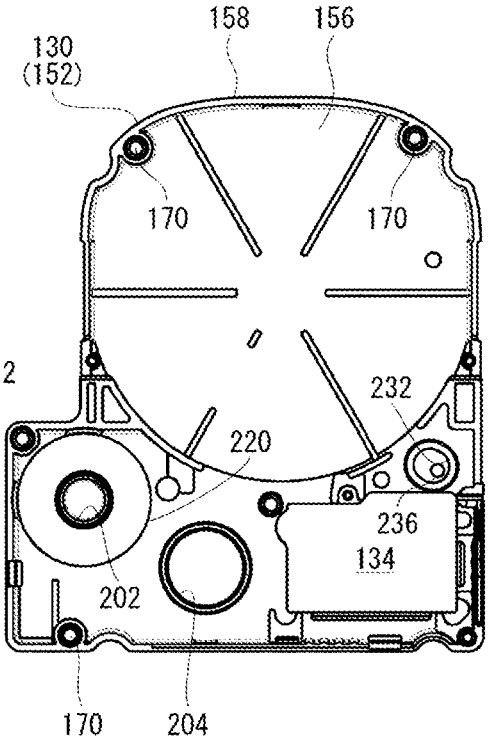

The ribbon roll 114 includes a circular leaf spring 220 that applies a braking load to the feeding-out core 112, besides the ink ribbon 110 and the feeding-out core 112 (see FIG. 5B). The leaf spring 220 is formed to be wavy in the peripheral direction and interposed between the top wall portion 156 of the upper casing 152 and the feeding-out core 112 in the shaft direction. That is, a rotation braking load is applied to the feeding-out core 112 by the elastic force of the leaf spring 220. Thus, back tension is applied to the ink ribbon 110 fed out from the winding-up core 116 to prevent slack in the ink ribbon 110.

The feeding-out core 112 is formed in a cylindrical shape, and a plurality of notches 222 is formed in the peripheral direction at the end thereof on the side of the lower casing 150 (see FIG. 6). Further, the rotation-stop hooks 206 engage with or disengage from the plurality of notches 222. Note that the feeding-out-side bearing portion 202 on the side of the lower casing 150 supporting the feeding-out core 112 is constituted of a circular opening while the feeding-out-side bearing portion 202 on the side of the upper casing 152 is constituted of a cylindrical projection portion. Further, the leaf spring 220 is attached to the projection portion (see FIG. 5B about both of the constituents).

Similarly, the winding-up core 116 is formed in a cylindrical shape, and a plurality of notches 224 is formed in the peripheral direction at the end thereof on the side of the lower casing 150. Further, the rotation-stop hooks 206 engage with or disengage from the plurality of notches 224. In addition, a spline groove 226 is formed on the inner peripheral surface of the winding-up core 116 and spline-engages with the winding-up driving shaft 47. Thus, the rotation force of the winding-up driving shaft 47 is transmitted to the winding-up core 116 to wind up the ink ribbon 110.

On the left side of the base portion inside the cartridge casing 130, a platen accommodation area 230 is constituted adjacent to the insertion opening 134. At the center of the platen accommodation area 230, a lower bearing portion 234 (see FIG. 6) having an elliptical (oval) opening formed on the lower casing 150 and an upper bearing portion 232 (see FIG. 5B) having an elliptical opening formed on the upper casing 152 are provided. Further, by the upper bearing portion 232 and the lower bearing portion 234, the platen roller 120 is supported so as to be rotatable and slightly horizontally movable. That is, the platen roller 120 supported by the elliptical upper bearing portion 232 and the lower bearing portion 234 is configured to be horizontally movable (slightly movable) between a home position (restraint canceling position) at which the platen roller 120 engages with the platen driving shaft 45 and a holding position (restraint position) at which the platen roller 120 comes in contact with the tape guide 194 with the printing tape 102 held therebetween.

Meanwhile, when the tape cartridge 100 is carried, the fed-out end of the printing tape 102 is in a state of slightly projecting from the tape delivering port 138 to an outside (see FIG. 1). If a pressing force or a withdrawing force is falsely applied to the fed-out end of the printing tape 102 at this time, the platen roller 120 pulled by the force is moved to the holding position described above. Thus, the fed-out end of the printing tape 102 is prevented from being withdrawn into the cartridge casing 130 via the tape delivering port 138.

In addition, on the upper casing 152 (the top wall portion 156), a fitting portion 236 in which the tip end of the platen supporting shaft 48 fits is formed on the outside of the upper bearing portion 232. The fitting portion 236 is constituted of a fitting hole that penetrates the top wall portion 156. In addition, the fitting portion 236 communicates with the upper bearing portion 232 and is disposed coaxially with the upper bearing portion at the home position described above (that will be described in detail later).

The platen roller 120 includes a cylindrical roller base body 240 and a rubber roller 242 attached to the outer peripheral surface of the roller base body 240. The rubber roller 242 has a length corresponding to the printing head 21 in the shaft direction, and the printing head 21 comes in contact with the rubber roller 242 with the printing tape 102 and the ink ribbon 110 held therebetween when moving to a printing position. In addition, a spline groove 244 is formed on the inner peripheral surface of the roller base body 240 and engages with the rotation driving shaft 49 of the platen driving shaft 45. Thus, the rotation force of the platen driving shaft 45 is transmitted to the platen roller 120 to print-feed the printing tape 102 (and the ink ribbon 110).

[Details of Fitting Portion and Platen Supporting Shaft]

Figure 7:
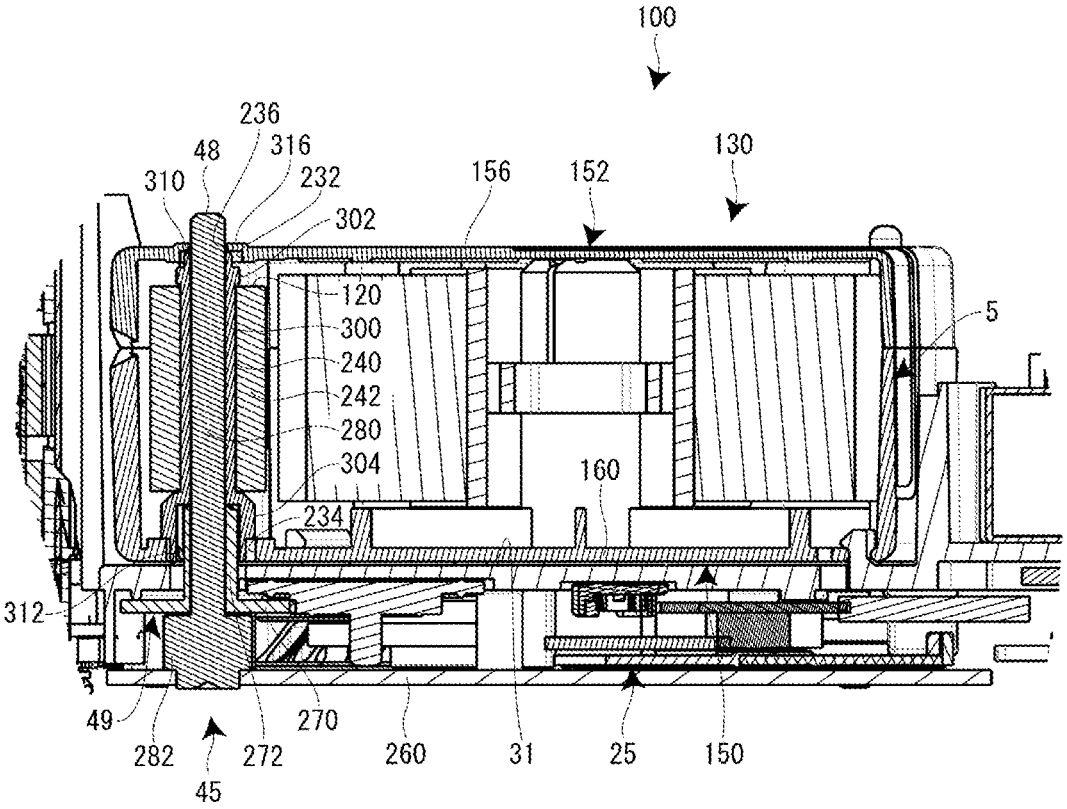
FIG. 7 is a cross-sectional view in a state in which the tape cartridge is installed on the cartridge installation portion.
Figure 8:
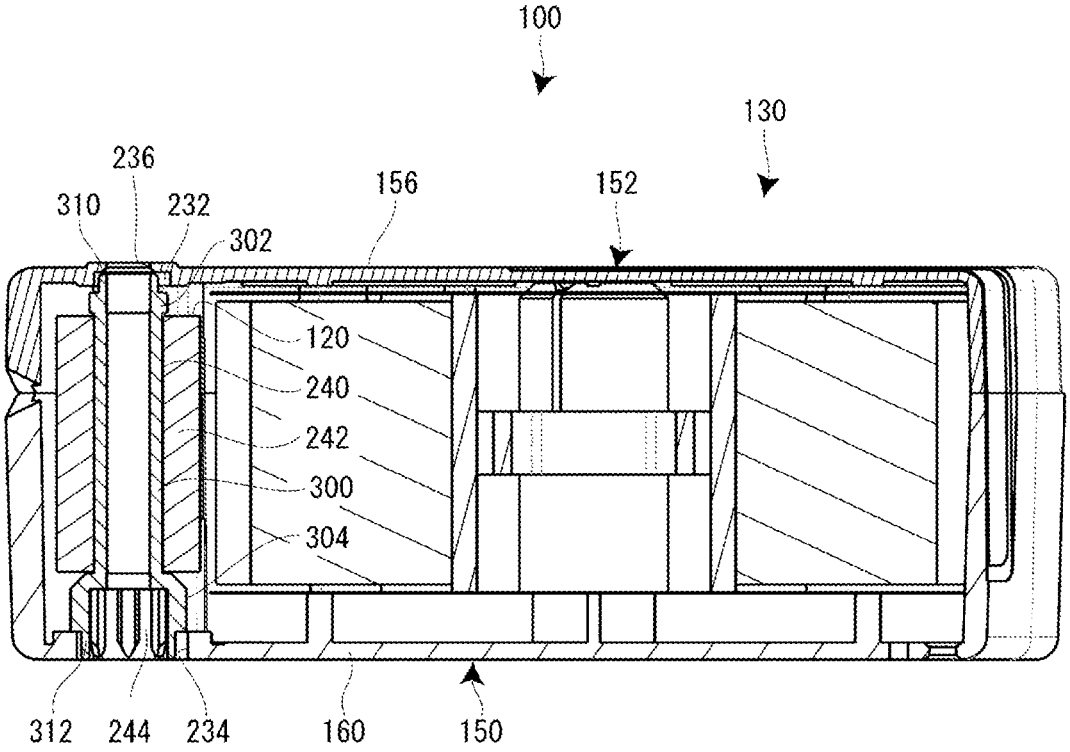
FIG. 8 is a cross-sectional view of the tape cartridge.

Next, with reference to FIG. 7 and FIG. 8, a description will be given in detail of a structure in the vicinity of the fitting portion 236 of the tape cartridge 100 in conjunction with the structure of the platen supporting shaft 48 of the platen driving shaft 45. FIG. 7 is a cross-sectional view in a state in which the tape cartridge 100 is installed on the cartridge installation portion 5, and FIG. 8 is a cross-sectional view of the tape cartridge 100.

As shown in FIG. 7, the platen driving shaft 45 includes the platen supporting shaft 48 provided to stand on an apparatus frame 260 positioned under the installation base 31 and the rotation driving shaft 49 rotatably supported by the lower portion of the platen supporting shaft 48. The rotation driving shaft 49 includes a gear portion 270 constituted of a spur gear and a spline portion 272 integrally formed with the gear portion 270. Further, the gear portion 270 is joined to the tape feeding mechanism portion 25.

In addition, the platen supporting shaft 48 is integrally formed by a straight-shaped shaft main body 280 and a shaft fixation portion 282 communicating with the side of the base end of the shaft main body 280. The shaft fixation portion 282 is press-fitted in a lower hole formed on the apparatus frame 260, whereby the platen supporting shaft 48 is fixed to the apparatus frame 260. That is, the platen supporting shaft 48 extending in the attaching/detaching direction of the tape cartridge 100 is fixed to the apparatus frame 260 at one end thereof. The platen supporting shaft 48 of the embodiment extends from the apparatus frame 260 so as to be crossed, and the shaft main body 280 penetrates the installation base 31 to be exposed to the inside of the cartridge installation portion 5. Further, the tip end of the platen supporting shaft 48 is chamfered to be substantially the same in height as the head cover 43.

When the tape cartridge 100 is installed on the cartridge installation portion 5 (an installation direction represents a direction from the tip end to the base end of the platen supporting shaft 48 and a removing direction represents a direction opposite to the installation direction), the platen supporting shaft 48 (the shaft main body 280) extending in the attaching/detaching direction is inserted in the roller base body 240 and the rotation driving shaft 49 engages with the lower end of the roller base body 240. That is, the platen roller 120 is rotatably supported by the platen supporting shaft 48 and rotated and driven by the rotation driving shaft 49 in this state.

As shown in FIG. 7 and FIG. 8, the platen roller 120 includes the roller base body 240 and a rubber roller 242 attached to the roller base body 240. The roller base body 240 is formed in a stepped cylindrical shape. The roller base body 240 is integrally formed (molded) by a roller retention portion 300 retaining the rubber roller 242, an annular boss portion 302 communicating with the upper side of the roller retention portion 300, and an annular engagement portion 304 communicating with the lower side of the roller retention portion 300 and having the spline groove 244 formed on the inner peripheral surface thereof.

The circular boss portion 302 functions as a portion for preventing the rubber roller 242 from coming off and includes an upper rotation engagement portion 310 rotation-engaging with the upper bearing portion 232 on the side of the tip end thereof. In addition, the circular engagement portion 304 functions as a portion for inputting rotation power and includes a lower rotation engagement portion 312 rotation-engaging with the lower bearing portion 234 on the side of the base end thereof. That is, in the vicinity of the upper rotation engagement portion 310 and the lower rotation engagement portion 312, the platen roller 120 is rotatably supported by the top wall portion 156 (the upper bearing portion 232) of the upper casing 152 and the bottom wall portion 160 (the lower bearing portion 234) of the lower casing 150 in a state of being supported at both ends thereof (i.e., in a state where displacements in both ends of the platen supporting shaft 48 in the direction crossing a direction in which the platen supporting shaft 48 extends are restricted and are not allowed unlimitedly).

As described above, the upper bearing portion 232 on the near side in the installation direction (on the side of the tip end of the platen supporting shaft 48) and the lower bearing portion 234 on the back side in the installation direction (on the side of the rotation driving shaft 49) are formed in the oval (elliptical) shapes in plan view, and the platen roller 120 is supported by the cartridge casing 130 so as to be rotatable and slightly movable (horizontally movable). Note that this slight movement represents the movement of the platen roller 120 with the withdrawn printing tape 102 (a friction force), i.e., the movement in a direction obliquely crossing the tape guide 194. Thus, the printing tape 102 is held between the platen roller 120 and the tape guide 194 to prevent unexpected entanglement with the printing tape 102.

Figure 9:
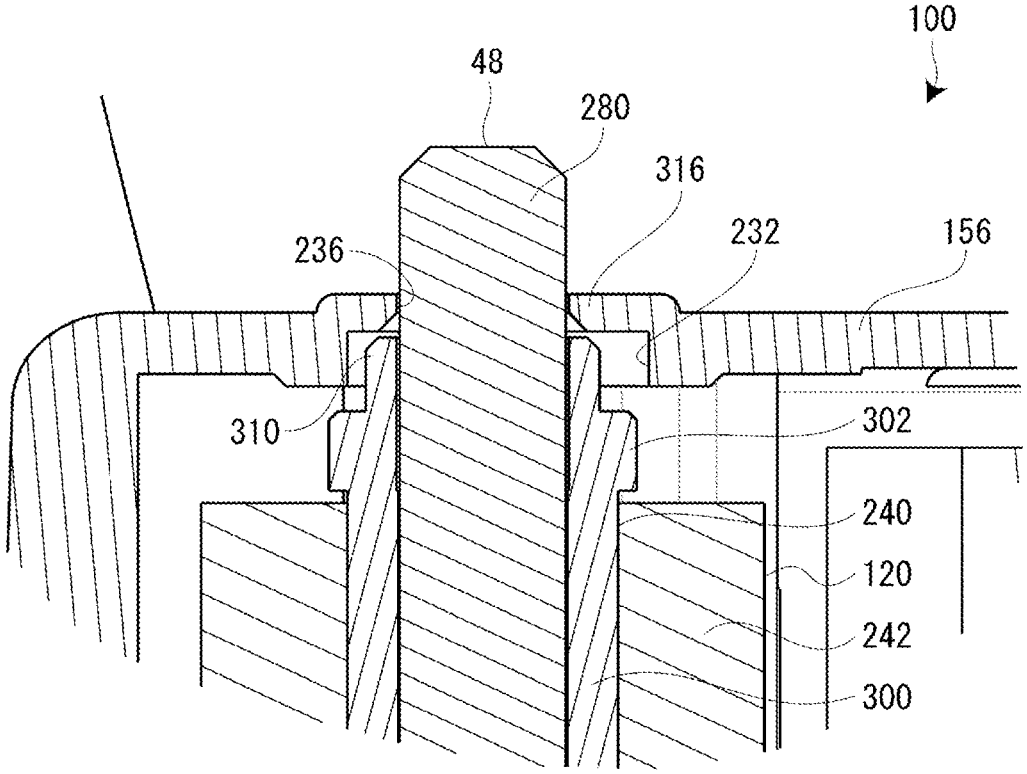
FIG. 9 is an enlarged cross-sectional view showing the relationship between a platen supporting shaft and the fitting portion of the tape cartridge.

On the other hand, as shown in FIG. 9, the fitting portion 236 in which the tip end of (the shaft main body 280 of) the platen supporting shaft 48 fits is formed on the outside of the upper bearing portion 232 on the top wall portion 156 of the upper casing 152. In this case, in order to spatially constitute the oval upper bearing portion 232, the top wall portion 156 has a slightly arising covering wall portion 316 when seen from the direction of the platen supporting shaft 48 of the platen roller 120 (when seen from the side of the tip end to the side of the base end of the platen supporting shaft 48), and the fitting portion 236 is formed at the covering wall portion 316. In addition, a leading slant surface is provided at the circular margin of the covering wall portion 316 having the fitting portion 236 to reduce the catching of the tape cartridge 100 when the tape cartridge 100 is installed on the cartridge installation portion 5.

As described above, the fitting portion 236 is constituted of a fitting hole (through hole), and the tip end of the platen supporting shaft 48 is fitted and inserted in the fitting portion 236. In addition, as described above, the fitting portion 236 is disposed coaxially with the upper bearing portion 232 at the home position (i.e., the position inside the oval-shaped upper bearing portion 232 where the upper rotation engagement portion 310 should exist in the restraint canceling state). Accordingly, when the tape cartridge 100 is installed on the cartridge installation portion 5, the platen roller 120 is restrained by the platen supporting shaft 48 and automatically moves to the home position. Further, the platen supporting shaft 48 and the fitting portion 236 have a size tolerance that causes no rattling, and the fitting portion 236 holds the tip end of the platen supporting shaft 48 supported at one end thereof on the side of the base end (the lower side) (restricts displacements in the direction crossing the direction in which the platen supporting shaft 48 extends).

As described above, according to the embodiment, the fitting portion 236 of the tape cartridge 100 installed on the cartridge installation portion 5 fits in the tip end of the platen supporting shaft 48 of the platen driving shaft 45. Thus, the tip end of the platen supporting shaft 48 supported at one end thereof on the side of the base end is held by the fitting portion 236. That is, only by the installation of the tape cartridge 100 on the cartridge installation portion 5, the platen supporting shaft 48 can be supported at both ends thereof. Accordingly, the platen supporting shaft 48 is allowed to be supported at both ends thereof with the simple structure and the simple operation.

Thus, even in a printing operation state in which the platen roller 120 supported by the platen supporting shaft 48 receives a pressing force from the printing head 21, the printing head 21 and the platen roller 120 can nearly uniformly come in contact with each other with a reduction in the inclination of the platen roller 120. Accordingly, high printing quality can be secured. In addition, even if the platen roller 120 resonates due to vibrations resulting from a printing operation, the resonance can be effectively controlled by the fitting portion 236 in such a way as to reduce displacements in the tip end of the platen supporting shaft 48, of which the side of the base end is supported, in the direction crossing the platen supporting shaft 48 (i.e., the displacements in the portion that vibrates in the direction crossing the shaft direction with a displacement having a maximum amplitude if the platen supporting shaft 48 is supported at one end thereof).

In addition, only if the fitting portion 236 is constituted of a penetrating fitting hole, the platen supporting shaft 48 can fit in the fitting portion 236 irrespective of the thickness type of the tape cartridge 100 provided that the platen supporting shaft 48 is formed to have a length corresponding to the tape cartridge 100 having a maximum width with respect to the plurality of types of tape cartridges 100 having a different thickness. Accordingly, the platen supporting shaft 48 can be supported at both ends thereof irrespective of the thickness of the tape cartridge 100 installed on the cartridge installation portion 5.

Note that in the tape cartridge 100 having a maximum width, the fitting portion 236 can be formed in a bag shape. Thus, the catching of the fitting portion 236 at the front surface of the upper casing 152 can be reduced. In addition, even in the tape printing apparatus 1 in which the tape cartridge 100 is installed based on the upper surface thereof, the fitting portion 236 is not necessarily a through hole.

What is claimed is:

1. A tape cartridge detachably installed on a cartridge installation portion of a tape printing apparatus having a platen supporting shaft and a printing head, a base end of the platen supporting shaft being fixed to the cartridge installation portion at one end of the platen supporting shaft and extending in an attaching/detaching direction of the tape cartridge, the tape cartridge comprising:

a platen roller through which the platen supporting shaft passes when the tape cartridge is installed on the cartridge installation portion and which receives a pressing force from the printing head when a printing operation is performed in a state in which the tape cartridge is installed on the cartridge installation portion, the platen roller including an upper engagement portion and a lower engagement portion;

an upper bearing portion which rotatably supports the upper engagement portion and restricts a movement of the upper engagement portion in a radial direction of the platen roller within a given range;

a lower bearing portion which rotatably supports the lower engagement portion and restricts a movement of the lower engagement portion in the radial direction within a given range; and a fitting portion in which a tip end of the platen supporting shaft passing through the platen roller fits when the tape cartridge is installed on the cartridge installation portion, the fitting portion having a fitting hole to support the tip end of the platen supporting shaft, wherein an end face of the platen roller at a near side of the attaching direction is covered by a cartridge casing in the attaching direction.

2. The tape cartridge according to claim 1, wherein the upper bearing portion and the lower bearing portion are provided on the cartridge casing.

3. The tape cartridge according to claim 2, further comprising:

a printing tape mounted on the cartridge casing so as to be fed out from the tape cartridge, wherein the upper bearing portion and the lower bearing portion allow the platen roller to move in the radial direction of the platen roller between a restraint position at which feeding of the printing tape is restrained and a restraint canceling position at which the restraint is cancelled, and the platen supporting shaft is inserted in the platen roller at the restraint canceling position when the tape cartridge is installed on the cartridge installation portion.

4. A tape cartridge detachably installed on a cartridge installation portion of a tape printing apparatus having a platen supporting shaft and a printing head, a base end of the platen supporting shaft being fixed to the cartridge installation portion at one end of the platen supporting shaft and extending in an attaching/detaching direction of the tape cartridge, the tape cartridge comprising:

a platen roller;

an upper bearing portion which rotatably supports an upper engagement portion of the platen roller and restricts a movement of the upper engagement portion in a radial direction of the platen roller within a given range; and a lower bearing portion which rotatably supports the lower engagement portion of the platen roller and restricts a movement of the lower engagement portion in the radial direction within a given range; and a fitting portion in which a tip end of the platen supporting shaft passing through the platen roller fits when the tape cartridge is installed on the cartridge installation portion, the fitting portion having a fitting hole to support the tip end of the platen supporting shaft, wherein an end face of the platen roller at a near side of the attaching direction is covered by a cartridge casing in the attaching direction.

* * * * *